United States Patent [19]

DeCosmo

[11] 4,399,172

[45] Aug. 16, 1983

[54] ARTIFICIAL TREE CONSTRUCTION

[75] Inventor: Anthony DeCosmo, Aurora, Ill.

[73] Assignee: American Technical Industries, Inc., Pittsburgh, Pa.

[21] Appl. No.: 421,039

[22] Filed: Sep. 22, 1982

[51] Int. Cl.[3] ..... A47G 33/06

[52] U.S. Cl. ..... 428/8; 211/205; 428/20

[58] Field of Search ..... 428/10, 18, 19, 20, 428/8; 211/196, 205

[56] References Cited

U.S. PATENT DOCUMENTS

| | | | |
|---|---|---|---|
| 2,849,822 | 9/1958 | Bachman | 428/10 X |
| 3,064,379 | 11/1962 | Hertzberg | 428/18 X |
| 3,692,617 | 9/1972 | Marks et al. | 428/20 |
| 4,133,922 | 1/1979 | Smith | 428/10 |

*Primary Examiner*—Henry F. Epstein

*Attorney, Agent, or Firm*—Thomas H. Murray

[57] ABSTRACT

An artificial Christmas tree construction wherein artificial foliage (i.e., pine needles) is secured to rings of successively smaller diameter. The rings are supported on rods which extend outwardly and downwardly from a central support column. The tree may be stored and shipped in a carton of smaller volumetric capacity than is required for prior art artificial tree constructions.

6 Claims, 6 Drawing Figures

ARTIFICIAL TREE CONSTRUCTION

BACKGROUND OF THE INVENTION

As is known, artificial trees, particularly artificial Christmas trees, usually comprise a central support column from which artificial boughs extend. The boughs are formed from essentially straight wire members to which plastic straws or strips, resembling pine needles, are secured. The artificial boughs are secured to the upright column in various ways and usually must be inserted or removed one-by-one in assembling or disassembling the tree. Ordinarily, the upper part of the tree is formed in one part and comprises a plug or cap carried on the upper extremity of the support column, the plug being provided with projecting artificial boughs of relatively short length to form the upper apex of the tree.

Aside from the fact that such prior art artificial trees are formed from a relatively large number of parts which must be assembled and disassembled, they require a shipping carton of relatively large size, necessitating the use of a large amount of warehouse space by distributors and retailers who sell them.

STATEMENT OF THE INVENTION

In accordance with the present invention, a new and improved artificial tree construction is provided in which the number of individual parts is reduced and in which the boughs do not extend outwardly from a central support column. Rather, the boughs are secured to wire or the like rings of progressively smaller diameter which rest on support members and which extend downwardly and outwardly from a central support column. This produces a construction in which a central cone-shaped portion of the completed tree, which is unseen, is void but surrounded by artificial boughs carried on the aforesaid rings.

The improved construction of the invention not only reduces the required number of tree parts but also enables the disassembled tree to be stored and shipped in a carton of much smaller volumetric capacity, a distinct advantage to distributors and retailers who sell such trees.

The above and other objects and features of the invention will become apparent from the following detailed description taken in connection with the accompanying drawings which form a part of this specification, and in which.

Figure 1:
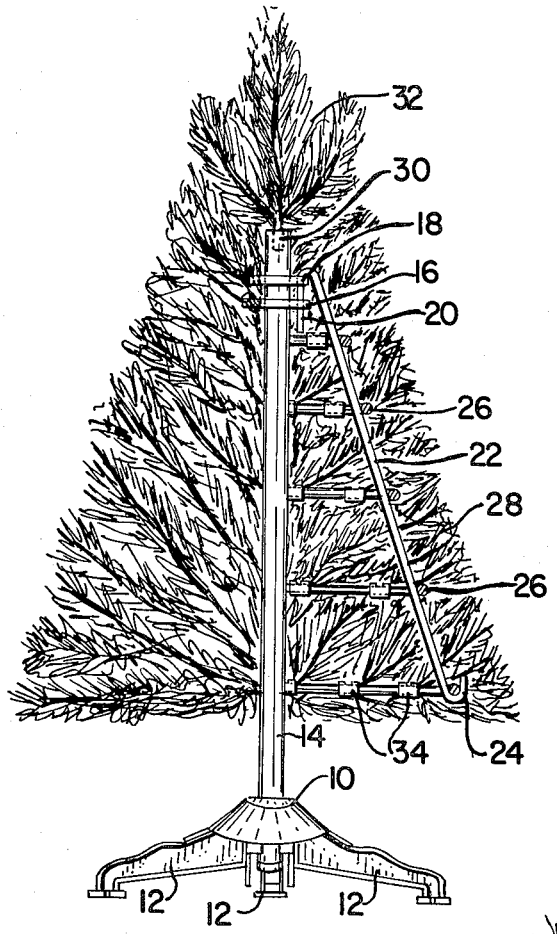
FIG. 1 is an elevational view, partly in section, of the improved tree construction of the invention.
Figure 2:
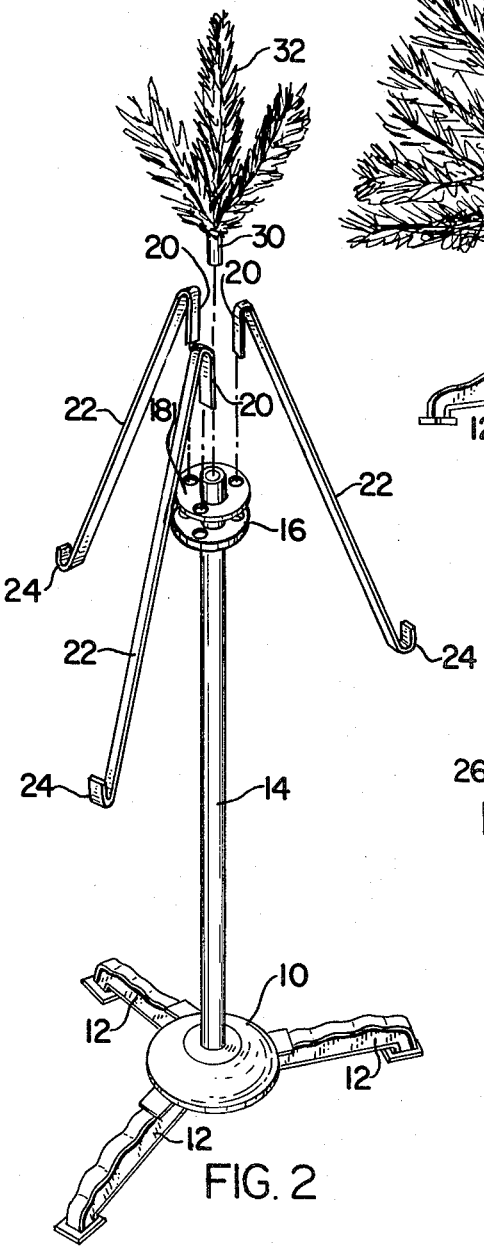
FIG. 2 is an exploded view showing the manner in which the tree of FIG. 1 is assembled from its component parts.

With reference now to the drawings, and particularly to FIGS. 1 and 2, the tree construction shown includes a base 10 having three legs 12 arranged in a tripod arrangement. Extending upwardly from the base 10 is a central support column 14 which carries, at its upper end, two annular plates 16 and 18. The plates 16 and 18 have holes or slots formed therein which receive downwardly-bent portions 20 of support rods 22 which extend downwardly and outwardly at an acute angle with respect to the axis of the central support column 14. At the bottom of each of the rods 22 is an upwardly-bent portion 24 forming a hook. Received on, and supported by, the three support rods 22 are rings 26, each of which has fastened thereto artificial Christmas tree boughs 28 which form an annular cluster around the center of each circular ring 26. Secured to the upper end of the central support column 14 is a plug or cap 30 to which are secured artificial boughs 32 forming the upper apex of the Christmas tree configuration.

Figure 3:
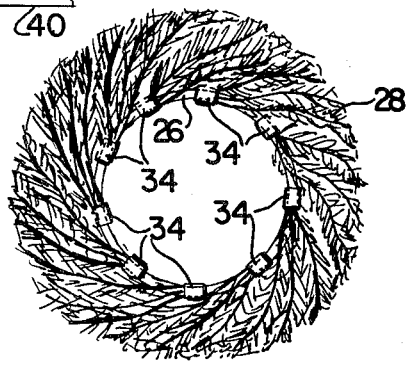
FIG. 3 illustrates details of one manner in which artificial boughs may be connected to wire ring members used in the tree construction.

One manner in which the artificial boughs are joined to the rings 26 is illustrated in FIG. 3. In this embodiment, the ring is a solid wire; and the individual boughs 28 are bent at right angles adjacent their inner ends and secured to the ring 26 by clips 34. Alternatively, the rings 26 could be formed from twisted wire and the inner ends of the boughs simply secured between the twists or turns of the wire.

In order to assemble the tree, the column is inserted into base 10 and the downwardly-bent portions 20 of rods 22 inserted into the openings in plates 16 and 18. The largest diameter ring 26 is then slipped over the top of the column 14 and caused to rest on the hooks 24. Rings 26 of successively smaller diameter are then lowered onto the rods as shown in FIG. 1. The outward inclination of the rods 22 prevents the rings from slipping down the rods any further than dictated by their diameters. Finally, the plug 30 is inserted into the top of column 14 to complete the tree.

In order to disassemble the tree, the plug 30 is simply removed along with the rings 26 in succession which can be stored in side-by-side relationship within a carton. The support rods 22 are then removed from the slots or holes in the plates 16 and 18 and the base 10 removed such that all parts may be assembled in the carton in closely-spaced relationship. When the tree is assembled as shown in FIG. 1, for example, there is a conical central void surrounded by artificial boughs 28; however this void is not visible through the boughs.

Figure 4:
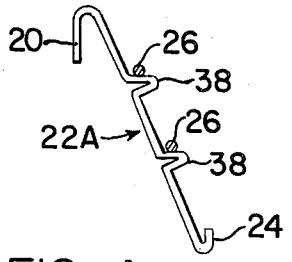
FIG. 4 illustrates an alternative embodiment of the support rods of the invention.
Figure 5:
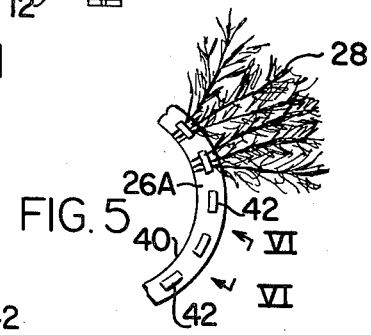
FIG. 5 illustrates an alternative embodiment of the bough-carrying rings of the invention.
Figure 6:
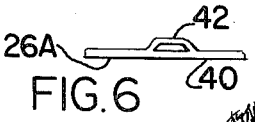
FIG. 6 is a view taken along line VI—VI of FIG. 5.

In FIG. 4, an alternative embodiment of the support rods is shown. In this case, the rod 22A is bent or crimped to form ledges 38 on which the rings 26 rest. In FIGS. 5 and 6, another embodiment of the bough-carrying rings is shown wherein the ring 26A is formed from flat sheet metal 40 having clips 42 stamped therein under which the ends of the boughs 28 can be inserted and secured in place by a slight depression of the clips. The rings 26 shown in FIG. 1 can be round or square, and can be formed from metal or plastic with holes into which the ends of the boughs are inserted. Likewise, the rods 22 can be of round or rectangular cross-section and covered with plastic tubing if desired.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. An artificial tree construction comprising a base member, an upright support column extending upwardly from the base member, a plurality of support members extending outwardly from the upper end of the support column with the column being the sole support for the support members, each of said support members being inclined downwardly and outwardly from their connection to the support column and terminating at their lower ends above said base member, a plurality of rings of progressively smaller diameter resting on said support members and vertically spaced thereon with the ring of largest diameter being at the lower extremities of the support members, artificial foliage secured to said rings and projecting radially outwardly therefrom, and a plug carrying artificial foliage carried on the upper extremity of said support column.

2. The artificial tree construction of claim 1 wherein the lower ends of said support members are bent upwardly to form hooks for supporting the ring of larger diameter in said plurality of rings.

3. The artificial tree construction of claim 2 including means for releasably securing the upper ends of said support members to said support column.

4. The artificial tree construction of claim 3 including spaced annular plates carried at the upper end of said support column, and openings in said spaced annular plates for receiving downwardly-bent portions of said support members to secure them in place.

5. The artificial tree construction of claim 1 wherein said rings comprise solid wire rods and including clips for securing the foliage to the wire rods.

6. The artificial tree construction of claim 1 wherein said rings are formed from twisted wires and wherein ends of the foliage are clamped between twists in the wires.

* * * * *